United States Patent [19]

McCarter

[11] 4,260,660

[45] Apr. 7, 1981

[54] USE OF SULPHUR AS AN ADDITIVE TO INHIBIT THE SMOLDERING COMBUSTION OF MATERIALS

[75] Inventor: Robert J. McCarter, Gaithersburg, Md.

[73] Assignee: The United States of America as represented by the Secretary of Commerce, Washington, D.C.

[21] Appl. No.: 886,384

[22] Filed: Mar. 14, 1978

Related U.S. Application Data

[63] Continuation-in-part of Ser. No. 788,951, Apr. 19, 1977, abandoned.

[51] Int. Cl.[2] ..... A47C 27/00

[52] U.S. Cl. ..... 428/284; 5/459; 29/91.1; 29/91.5; 297/DIG. 5; 427/393.3; 428/286; 428/287; 428/291; 428/289; 428/290; 428/304; 428/688; 428/310; 428/341; 428/543

[58] Field of Search ..... 5/345 R, 459; 297/DIG. 5; 428/291, 543, 538, 284, 286, 287, 289, 290, 304, 310, 341; 29/91.1, 91.5; 427/390 D

[56] References Cited

U.S. PATENT DOCUMENTS

| | | | |
|---|---|---|---|
| 1,836,660 | 12/1931 | Haertel | 428/538 |
| 3,542,701 | 11/1970 | Raamsdonk | 260/2.5 |
| 3,774,250 | 11/1973 | Miller | 5/345 R |
| 3,833,951 | 9/1974 | Hurwitz | 5/345 R |
| 3,934,285 | 1/1976 | May | 427/390 D |
| 4,012,507 | 3/1977 | Knoepfler et al. | 428/921 |

FOREIGN PATENT DOCUMENTS

| | | | |
|---|---|---|---|
| 1477145 | 6/1977 | United Kingdom | 427/390 D |

OTHER PUBLICATIONS

Agafonov et al., Chem. Abstracts, vol. 86, 157838c (1977).

*Primary Examiner*—John D. Smith
*Attorney, Agent, or Firm*—Eugene J. Pawlikowski; Alvin J. Englert

[57] ABSTRACT

Disclosed is a smolder resistant upholstered furniture or mattress assembly and a method for rendering the composite materials of such assembly smolder resistant. Placement of a layer of sulphur immediately adjacent a normally smolder-prone material in the composite effectively prohibits the advances of smoldering combustion to a dangerous stage. The sulphur layer is advantageously applied by backcoating the fabric overlay, coating or impregnating the fibrous or polyurethane foam materials or separating layers of such materials with sulphur-containing films, fabrics and the like. An advantageously effective amount of sulphur is from about 25–50 g/m$^2$ to about 250–300 g/m$^2$ in a layer having a depth of about 1 to 3 mm.

15 Claims, 4 Drawing Figures

USE OF SULPHUR AS AN ADDITIVE TO INHIBIT THE SMOLDERING COMBUSTION OF MATERIALS

Figure 1:
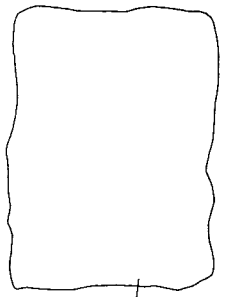

This application is a continuation-in-part of application Ser. No. 788,951, filed Apr. 19, 1977 and now abandoned.

The present invention is concerned with providing smolder resistant materials for use in mattress and upholstered furniture assemblies, and more particularly, to a method for preventing dangerous smoldering combustion in normally smolder-prone materials. Surprisingly, the mere presence of sulphur immediately adjacent to a smolder-prone material, especially the conventional cellulosic materials and polyurethane foams utilized in mattresses and upholstered furniture assemblies, substantially prevents the advance of smoldering combustion.

It is well known that mattresses and upholstered furniture present potentially dangerous possibilities from a smoke and smolder standpoint, totally unlike the fire hazard properties of other flammable materials often found in the home. Frequently, fatal or otherwise disastrous fires result from smoking in bed, usually because the smoker falls asleep and his lighted cigarette drops onto the bedding to cause a slow and ever-increasing smoldering combustion condition producing asphyxiating fumes and damaging smoke. Recently, extensive efforts have been undertaken to overcome the smolder tendencies of the material utilized in the manufacture of mattress and upholstered furniture assemblies. Published literature has very recently disclosed the newly recognized ability of sulphur in reducing the smolder tendency of upholstery-type fabrics. See for example an articles in the June, 1977 issue of *Bedding Magazine,* entitled "Sulphur vs. Cigarette Ignition" where it is indicated that "The Consumer Product Safety Commission is currently considering an upholstered furniture flammability standard which would require that all upholstered furniture be cigarette-ignition-resistant."

Earlier efforts are reported in the literature of attempts at reducing the smoldering tendencies of polyurethane foams and cellulosic-type materials. See McCarter "Smoldering of Flexible Polyurethane Foam", *The Journal of Consumer Product Flammability,* Vol. 3, 1976, pages 128–140, and McCarter, "Smoldering Combustion of Cotton and Rayon", *Proceedings of the Fifth Annual Symposium on Textile Flammability,* Apr. 20-21, 1977.

While these more recent attempts have led directly to the subject matter of the present invention, earlier patent literature is concerned primarily with flame retardancy of cellulosic or polymeric foamed materials. For example, U.S. Pat. No. 3,542,701 to Gerrit W. van Raamsdonk discloses a process for rendering polystyrene foams flame retardant by incorporating sulphur into the polystyrene bead precursor mix. U.S. Pat. No. 1,853,818 to Kobbe suggests the addition of diphenyls as a flame proofing agent in the case of sulphur-treated pulp and paper products. The fire proofing agent may be the diphenyl or chlorinated diphenyl or a mixture thereof. While these methods of controlling the flame resistance of upholstery-type material have met with considerable success, none of the described methods of the patent literature address the problem of smoldering combustion in such materials.

Accordingly, it is a principal object of the present invention to provide a smolder resistant upholstered furniture or mattress assembly and a method of rendering the composite materials of such assembly smolder resistant.

Other objects are the production of smolder resistant materials in a highly economic utilization of readily available materials at a convenient stage in the normal manufacturing process.

Broadly stated, the objects of the invention are realized by applying to a smolder-prone material of the composite, a layer of sulphur immediately adjacent thereto. Some preferred methods include the coating of the composite materials with sulphur in a wide array of forms, as well as impregnating composite materials and impregnating films, fabrics and the like for placement between the layers of composite materials. In each of these instances, the final upholstered furniture or mattress assembly is remarkably resistant to smoldering combustion and, the aforementioned objects and advantages of the present invention are achieved along with additional advantages which will become apparent from the following description.

Smoldering combustion may be defined as oxidation of solid materials without visible flame and is assumed to be a heterogeneous surface reaction. It is presently a serious health hazard in the United States and in the world in that it is an insidious killer due to the capacity of its vapor products to overcome people in their sleep. Other names of smoldering combustion are glowing and non-flaming combustion.

Two areas where smoldering combustion are of acute interest at the present time are (1) cellulosics such as rayon, cotton, etc., used in padding or fabrics in upholstered furniture or bedding and as light weight fiberboard in structures, and (2) flexible polyurethane foam as cushioning in upholstered furniture or bedding.

The application to cellulose presents the most direct problem. Cellulose pyrolyzes directly from solid to vapor without interim plasticity and thereby in general is strongly prone to smolder. Cellulose materials which are of particular interest are cotton, rayon, and wood fibers. It is noted that in the absence of impurities, cellulosic materials are relatively immune to smolder (examples are absorbent cotton, ashless filter paper, clean undyed cotton or rayon fabrics).

Among smolder promoting compounds in cellulosics are the hydroxides, chlorides, and bromides of the monovalent alkaline metals (Li, Na, K, Cs, Rb) and salts of iron, chromium, and lead. Specifically, of the sodium salts, only the fluoride, sulphate and borate are ineffective as smolder promoters.

Smolder of flexible polyurethane foam is a more varied and complex process than that of the cellulosics. Most foams smolder only in conjunction and interaction with another fuel; e.g., with the overlayment of smoldering upholstery fabrics.

In the environment of both cellulose and polyurethane foam mattresses and upholstery materials, smoldering (glowing, non-flaming) combustion is presumably an oxidation reaction at the interface between a gas phase containing oxygen (Reactant A) and a carbon-rich solid (Reactant B) producing various gases (Reaction Products C), such as carbon monoxide and carbon dioxide.

$$\text{Gas A} + \text{Solid B} \rightarrow \text{Gases C}$$

In the region of the interface, it appears that there are molecules or stable compounds, such as $O_2$, CO, $CO_2$ and $H_2O$ and active atomic species, such as O, H, OH, and $HO_2$, undergoing various sequential or chain reactions with each other and the reacting solid to result in the overall oxidation reaction.

It is believed that an inhibitor of smoldering combustion may function by interacting, in either the gas or the solid phase, with one or more of the active atomic species so as to prevent, disrupt, terminate or delay these species' participation in the chain of reaction, thereby slowing or stopping the entire chain and overall reaction.

It appears that this function is performed by the highly reactive vaporized form, $S_2$, of sulphur, probably in the gas phase near the reaction interface or, less likely, in the solid phase after reaction and deposition thereon. This function has been described as acting as a free radical scavenger. Sulphur has an appreciable vapor pressure (10 mm at 246° C., 100 mm Hg at 333° C., 400 mm HG at 407° C.). Sulphur is believed to be particularly effective as an inhibitor of smoldering combustion by reason of its volatility or ability to sublime and form a vapor of $S_2$ from surfaces in proximity to a smolder zone, the $S_2$ then being borne into the smolder zone in its inflowing air.

The dosage of sulphur, which may be applied by melting deposited solids onto the material, by vapor deposition, by liquid impregnation, or by deposition from a liquid carrier in a solution, suspension emulsion or the like, is an amount sufficient to prevent substantial smoldering of the material. In one preferred embodiment at least 25 g/m$^2$ is required to protect mattresses and upholstery materials where at least the surface of said material adjacent a vulnerable area is coated or impregnated. Such material surface may be flexible polyurethane foam overlayed with a smolder-prone fabric or a cellulosic outer layer overlayed with a smolder prone fabric. The smolder-prone fabric may most advantageously be rendered smolder resistant by application of sulphur in the conventional back-coating operation, i.e., application of an elastomeric coating to the underside of the fabric. Practical dosage ranges from very small amounts effective adjacent non-smoldering materials to ranges of from 25–300 g/m$^2$. Wood fiberboard panels may be protected in dosages comparable to other cellulosics by coating or impregnating the panels during or after the last stage in their production.

The sulphur may be applied to materials during their production or in the course of their assembly into bedding or furniture units. Sulphur may be applied in various forms and ways, such as by deposition of liquid or vaporized sulphur, or by application of solid sulphur, such as in powder form, with subsequent melting in situ for improved adhesion, if required, or by deposition from liquid spray or liquids including solutions, emulsions, suspensions and the like. Commonly employed deposition solvents include carbon disulphide or carbon tetrachloride. Latex carriers are also excellent for back-coating operations. The latex may be the conventional back-coating latex or an additional smolder proofing latex. The impregnation or coating generally should extend about 1 to 3 mm into the material, or for a thinner material, through the material.

Proposed standards for cigarette ignition resistance of upholstered furniture are set out in PFF 6-76 Part 1633. These proposed standards divide upholstered fabrics into four categories, Classes A, B, C and D. Class D fabrics are those that produce one or more chars of 7.5 cm (3 in.) or greater on test panels in the glass fiberboard test and are termed smolder-prone fabrics. The latter test rests the test fabric on a glass fiberboard panel and measures the length and amount of smolder achieved. The remaining Classes A, B and C show greater resistance to smolder combustion. It has been found that Class D fabrics constitute the great majority of fabrics utilized in upholstered furniture presently in the United States and, as such, will not pass the necessary minimum test. With the addition of sulphur to prevent smolder, such upholstery fabrics may be utilized over such materials as cellulosics and polyurethane foams. Concurrent and related standards have been passed into law relating to bedding. In some cases where it may not be desirable to backcoat the fabric, the sulphur may be placed on an interliner, i.e., a layer of material placed between the fabric and the cushioning material. In such cases the dosage may be increased 25–100%, if necessary, and depending upon the smolder tendency of the adjacent material.

The present invention contemplates the addition of sulphur in amounts up to 300 g/m$^2$, preferably in the range of 25–300 g/m$^2$ to a depth of about 1 to 3 mm directly to fabrics and fibers including cellulosics, such as rayon, cotton batting, wood fibers, etc., as well as to such materials as flexible polyurethane foam, noeprene rubber and latex for the smolder resistance of assembled materials not otherwise protected by a treated overlayment.

Upholstery materials may be defined as a single layer such as cotton padding or polyurethane foam or a multilayer sandwich construction of the same materials which may include other layers, such as polyester fibers, muslin cloth, neoprene rubber, etc. In each case, the material is covered or enveloped with a smolder-prone fabric overlay.

FIGS. 1–4 depict a comparison of smolder combustion. In Example 1 a complete description is provided for FIG. 1.

EXAMPLE 1

This example refers to the four pictures shown from left to right, FIGS. 1–4.

FIG. 1 on the left denotes complete destruction of the cotton padding as the sign indicates.

Figure 2:
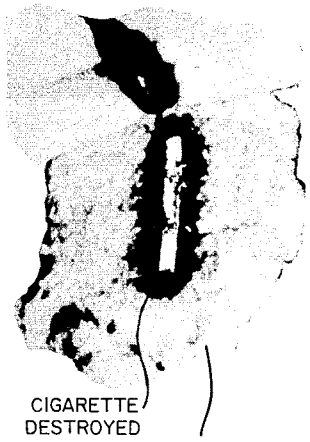

FIG. 2 denotes a sample wherein cotton was treated with boric anhydride similar to a process commonly utilized by industry. The results in this case show that the cigarette has burned completely, leaving a white ash and a modest amount of damage in the cotton. Were a Class D fabric overlay above this padding, it would have been consumed by smolder, initiated by the cigarette.

Figure 3:
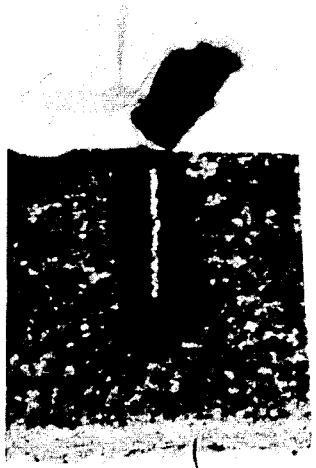

FIG. 3 shows a dark gray material which is a blend of polyester and cotton fibers (FLEXEL—Ramcom Company, Memphis, Tenn. In this case, the test cigarette burned to completion but the smolder did not progress very far into the fabric. Again a Class D fabric above this material would have been consumed.

Figure 4:
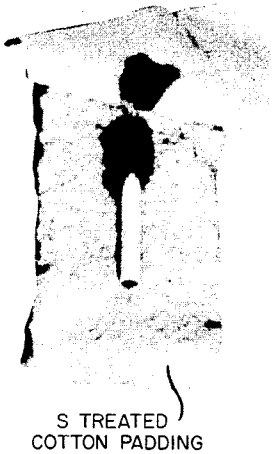

FIG. 4 shows ordinary cotton padding treated with sulphur according to the present invention. The test cigarette has extinguished at about one-third of its length. With a Class D fabric over the padding and underneath the cigarette the smolder in the upholstery fabric would have been extinguished.

EXAMPLE 2

The following tests were run on upholstered furniture assemblies, indicating the minimum treatments of sulphur as applied on surface or in the material for the assembly to pass the proposed Federal Upholstered Furniture Standard (cigarette test PFF6-76 Part 1633).

| Tests on Seats: | | |
|---|---|---|
| (a) | Class D fabric<br>Cotton padding | 80 g/m$^2$ of sulphur applied to outer surface of cotton padding |
| (b) | Class D fabric<br>Muslin (2 layers)<br>Cotton padding | 300 g/m$^2$ of sulphur applied to muslin layers |
| (c) | Class D fabric<br>Polyurethane foam<br>(½" thick)<br>Cotton padding | 40 g/m$^2$ of sulphur applied to outer surface of polyurethane foam |
| (d) | Class D fabric<br>Polyurethane foam<br>(½" thick)<br>Cotton padding | 50 g/m$^2$ of sulphur applied to inner surface of polyurethane foam |
| (e) | Class D fabric<br>Polyurethane foam<br>(½" thick)<br>Cotton padding | 50 g/m$^2$ of sulphur applied to outer surface of polyurethane foam |
| (f) | Class D fabric<br>Polyurethane foam<br>(½ thick)<br>Cotton padding | 85 g/m$^2$ of sulphur applied to inner surface of polyurethane foam |

As this example indicates, different quantities of sulphur are required for the different types of upholstery material. This also depends upon the area of application of the sulphur. Quantities of sulphur even lower than 25 g/m$^2$, for example, will also be suitable in certain applications.

EXAMPLE 3

In this example, several samples of fabric pieces were tested for increased smolder resistance after treatment with sulphur in various fabric back-coating methods. In each instance, the fabric piece was a Class D upholstery fabric. Comparisons were made of back-coating a completely untreated fabric sample with sulphur or a sulphur-containing composition, and treating a conventionally back-coated fabric sample with a further back-coating of sulphur or a sulphur-containing composition. The sulphur applications utilized include sulphur alone, sulphur plus sodium silicate, sulphur plus back-coating latex and sulphur plus sodium silicate plus back-coating latex. The latex utilized was a commercial latex conventionally used on upholstery fabric. Conventional back-coating latexes include the styrene butadiene rubber-type latex and the acrylic-type latex. Whichever latex is utilized, sulphur may be conveniently suspended in the latex composition prior to the back-coating application. On the other hand, the sulphur may also be suspended in the sodium silicate or water glass, and either applied to the fabric separately or mixed with the latex and back-coated in one operation. Particular test samples demonstrated that Class D fabrics could be up-graded to pass the cigarette ignition test by a highly advantageous and economical back-coating of sulphur. The back-coating compositions were employed as follows:

A. Powdered sulphur suspended in sodium silicate,
B. Powdered sulphur suspended in latex, and
C. Powdered sulphur suspended in latex and sodium silicate mixture.

EXAMPLE 4

The same investigation as indicated in Example 3 was conducted by applying the sulphur or sulphur-containing coating to the polyurethane foam slab to determine cigarette ignition resistance. Here again, a simple coating technique proved successful in providing a smolder resistant material.

As the above examples indicate, the addition of sulphur in a layer adjacent a smolder-prone material effectively up-grades the material to a smolder resistant material regardless of the particular application method of the sulphur. Accordingly, while the most economic method presently appears to be the addition of sulphur to the conventional fabric overlay back-coating operation, other methods of application may include dusting powdered sulphur onto fabric, foamed material and the like, fixing with heat, spraying onto the material as a liquid or in a solution, suspension, or emulsion, dipping the materials into a sulphur-containing composition or adding sulphur to the upholstery material in the process of assembly. It is, of course, advantageous to concentrate the sulphur layer in an area closest to the possible combustion source and, accordingly, the fabric overlay back-coating method is highly advantageous from the standpoint of effectiveness and economy.

Up-graded upholstery fabric of increased smolder resistance may also be conveniently utilized in the reupholstering industry. For this purpose, a back-coated fabric overlay containing the sulphur in an effective amount may be employed. Other possibilities include sulphur treated foam cushion material and sulphur treated cellulosic upholstery material which may simply be placed immediately under the reupholstered fabric. It is also contemplated that compositions of back-coating solution could be made available so that any fabric or any upholstery cushion-type material could be treated during a reupholstering operation. For example, an aerosol spray of sulphur-containing latex or back-coating solution could be applied to the fabric overlay, and air cured or heat set prior to reupholstering. These and the foregoing examples are not deemed to restrict the subject matter of the application, but rather are merely presented for illustrating the particular embodiments of the invention.

What is claimed is:

1. A composite upholstered furniture or mattress assembly comprising layers of material wherein the inside surface of the outermost, normally smolder-prone layer is in intimate contact with a fabric layer containing sulphur in an amount effective to render said assembly smolder resistant.

2. The composite upholstered furniture or mattress assembly of claim 1 wherein the fabric is selected from the group consisting of cotton, rayon, polyamide, polyolefin, wool and blends thereof.

3. The composite upholstered furniture or mattress assembly of claim 1 wherein the sulphur-containing layer is a latex upholstery-backcoating layer.

4. The composite upholstered furniture or mattress assembly of claim 1 wherein the effective amount of sulphur is an amount up to about 250–300 g/m$^2$ in intimate contact with a normally smolder-prone layer.

5. The composite upholstered furniture or mattress assembly of claim 4 wherein at least about 25 g/m$^2$ of sulphur is present.

6. The composite upholstered furniture or mattress assembly of claims 1, 4 or 5 comprising an outer layer of fibers and a smolder-prone fabric overlay wherein the backside of the fabric overlay is coated with a sulphur-containing backcoating composition.

7. The composite upholstered furniture or mattress assembly of claims 1, 4 or 5 comprising an outer layer of polyurethane foam and a smolder-prone fabric overlay wherein the backside of the fabric overlay is coated with a sulphur-containing backcoating composition.

8. A method of protecting a mattress or upholstered furniture assembly from smolder comprising, covering a normally smolder-prone material with a fabric layer containing sulphur in an amount effective to render said assembly smolder resistant.

9. The method of claim 8 wherein a mattress or upholstery fabric overlay is backcoated with a sulphur-containing composition and subsequently subjected to conditions to cure the backcoating.

10. The method of claims 8 or 9 wherein the effective amount of sulphur is from about 25 $g/m^2$ to about 250-300 $g/m^2$.

11. The method of claim 9 wherein the back-coating composition is a latex upholstery-backcoating composition.

12. The method of claim 8 wherein the normally smolder-prone material is a mattress or upholstery material selected from the group consisting of fabrics, fibers, synthetic resin foams, natural and synthetic rubbers, coatings and films of polymeric materials and combinations thereof.

13. The method of claim 12 wherein the fabrics are selected from the group consisting of cotton, rayon, polyamide, polyolefin, wool and blends thereof.

14. The method of claim 12 wherein the fibers are selected from the group consisting of cotton, rayon, and polyester.

15. The method of claim 12 wherein the synthetic resin foam is a polyurethane foam.

* * * * *